US009657245B2

(12) United States Patent
Ding

(10) Patent No.: US 9,657,245 B2
(45) Date of Patent: May 23, 2017

(54) DEVICE OF PRODUCING LOW-SULFUR HIGH-OCTANE-NUMBER GASOLINE WITH LOW COST AND METHOD THEREOF

(71) Applicant: BEIJING GRAND GOLDEN-BRIGHT ENGINEERING & TECHNOLOGIES CO., LTD., Beijing (CN)

(72) Inventor: Ranfeng Ding, Beijing (CN)

(73) Assignee: BEIJING GRAND GOLDEN-BRIGHT ENGINEERING & TECHNOLOGIES CO., LTD., Beijing (CN)

( * ) Notice: Subject to any disclaimer, the term of this patent is extended or adjusted under 35 U.S.C. 154(b) by 536 days.

(21) Appl. No.: 14/109,901

(22) Filed: Dec. 17, 2013

(65) Prior Publication Data

US 2014/0101989 A1 Apr. 17, 2014

Related U.S. Application Data

(63) Continuation of application No. PCT/CN2012/000859, filed on Jun. 21, 2012.

(30) Foreign Application Priority Data

Jun. 22, 2011 (CN) ..... 2011 1 0169487

(51) Int. Cl.
*C10L 1/06* (2006.01)
*C10L 1/185* (2006.01)
(Continued)

(52) U.S. Cl.
CPC ..... *C10L 1/1852* (2013.01); *C10G 67/00* (2013.01); *C10G 67/04* (2013.01); *C10G 69/00* (2013.01);
(Continued)

(58) Field of Classification Search
CPC ..... C10L 1/06; C10L 2200/0423; C10L 2270/023; C10L 2290/543
(Continued)

(56) References Cited

U.S. PATENT DOCUMENTS 6,338,791 B1 * 1/2002 Ragil ..... C10L 1/06 208/133
6,540,907 B1 4/2003 Towler et al. ..... 208/211
(Continued)

FOREIGN PATENT DOCUMENTS

CN 1470607 A 1/2004
CN 1580199 A 2/2005
(Continued)

OTHER PUBLICATIONS

International Search Report of International Application No. PCT/CN2012/000859, dated Nov. 8, 2012.

*Primary Examiner* — Ellen McAvoy
(74) *Attorney, Agent, or Firm* — J.C. Patents

(57) ABSTRACT

The invention relates to a device of producing low-sulfur high-octane-number gasoline with low cost and method thereof, the device is composed of an extractor, a first cutting column, an etherification device, a hydrogenation desulfurizer, a reforming pretreatment device, a second cutting column, an isomerization device, a reformer and a stabilizing device. Sulfur in raw material is enriched in extracted oil by introducing extractor in the invention, thereby reducing the scale of hydrogenation desulfurization device. The scale of reformer is increased by delivering heavy raffinate obtained from the first cutting column in the reformer. Benzene extractor and corresponding fractionation device are saved by adjusting the cutting temperature in the second cutting column, thereby greatly lowering investment and energy consumption, and increasing the gasoline yield. The investment of reformer is reduced, while the liquid yield is
(Continued)

increased by introducing the reforming patent technology. The sulfur content in gasoline products is lowered to 10 ppm by selecting the device and method. The device and method have obvious advantages in investment, hydrogenation scale, product cleanliness, quality, etc.

4 Claims, 1 Drawing Sheet

(51) Int. Cl.
*C10G 69/00* (2006.01)
*C10G 67/00* (2006.01)
*C10G 67/04* (2006.01)

(52) U.S. Cl.
CPC ..... *C10L 1/06* (2013.01); *C10G 2300/202* (2013.01); *C10G 2300/305* (2013.01); *C10G 2400/02* (2013.01)

(58) Field of Classification Search
USPC ..... 44/300
See application file for complete search history.

(56) References Cited

U.S. PATENT DOCUMENTS 7,052,598 B2 * 5/2006 Debuisschert ..... C10G 65/06 208/210
7,341,657 B2 * 3/2008 Li ..... C10G 45/64 208/210
7,731,836 B2 * 6/2010 Nicolaos ..... C10G 25/12 208/208 R
7,867,383 B2 * 1/2011 Ding ..... C10G 7/00 208/313
8,034,233 B2 * 10/2011 Picard ..... C10G 45/08 208/209
8,043,495 B2 * 10/2011 Podrebarac ..... C10G 45/02 208/212
8,236,172 B2 * 8/2012 Podrebarac ..... C10G 7/00 203/29
8,303,805 B2 * 11/2012 Hatanaka ..... C10G 11/00 208/210
8,349,754 B2 * 1/2013 Nagabhatla ..... B01J 29/44 502/60
8,419,929 B2 * 4/2013 Ding ..... C10G 35/00 208/63
8,419,930 B2 * 4/2013 Ding ..... B01D 3/009 208/78
8,486,258 B2 * 7/2013 Podrebarac ..... C10G 67/02 208/177
8,524,043 B2 * 9/2013 Ding ..... C10G 21/00 196/105
8,940,154 B2 * 1/2015 Ding ..... C10G 21/00 196/155
2012/0048778 A1 * 3/2012 Podrebarac ..... C10G 35/06 208/210
2013/0165717 A1 * 6/2013 McCarthy ..... C10G 69/04 585/310
2013/0237739 A1 * 9/2013 Zhou ..... C10L 1/06 585/802
2015/0166908 A1 * 6/2015 Touzalin ..... C10G 25/05 208/189
2015/0175910 A1 * 6/2015 Touzalin ..... C10G 35/06 208/57

FOREIGN PATENT DOCUMENTS

CN 1621497 A 6/2005
CN 101475833 A 7/2009

* cited by examiner

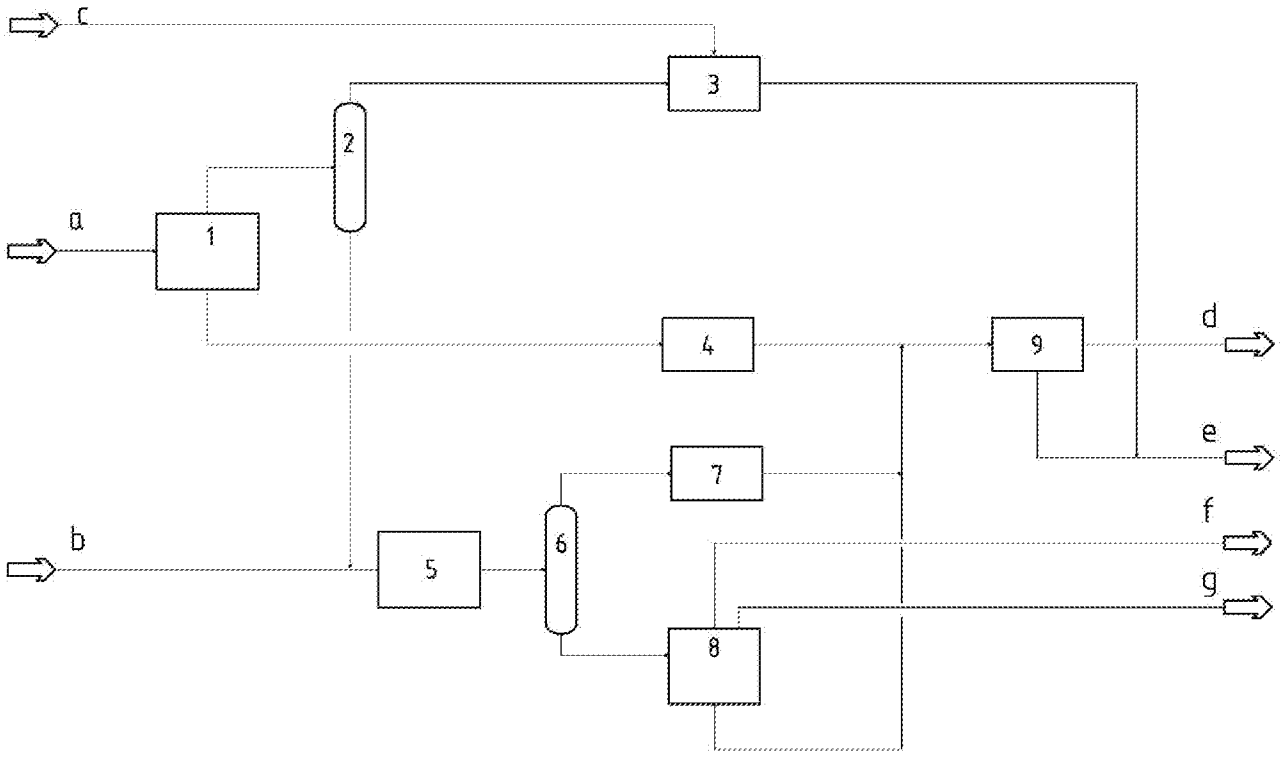
c
a
b
1
2
3
4
5
6
7
8
9
d
e
f
g

DEVICE OF PRODUCING LOW-SULFUR HIGH-OCTANE-NUMBER GASOLINE WITH LOW COST AND METHOD THEREOF

CROSS-REFERENCE TO RELATED APPLICATIONS

This is a continuation of international application PCT/CN2012/000859 with an international filing date of Jun. 21, 2012, which claims the benefit of Chinese application No. 201110169487.2 filed on Jun. 22, 2011, the contents of the above applications are herein incorporated by reference in their entirety.

TECHNICAL FIELD

The invention relates to a device of producing gasoline and method thereof, especially a device of producing low-sulfur high-octane-number gasoline with low cost and method thereof.

BACKGROUND TECHNOLOGY

Currently, internationally advanced gasoline quality standards are divided into four standard systems, namely, United States, European Union, Japan and World Fuel Specification. Although concrete limit values among various gasoline standards are different, the general trend is more and more stringent. European Union enforced ultra-low sulfur (ie 10 ppm) Euro V standards in 2009, Japan enforced ultra-low sulfur standards in 2008, the sulfur content in gasoline standards of U.S. California has been as low as 15 ppm, obviously, low-sulfur gasoline product is a general trend.

Meanwhile, crude oil has lower and lower quality as well as heavier and heavier weight. United States World Refining predicted that world crude oil average API will be declined from 32.5 in 2000 to 32.4 in 2010 and 32.3 in 2015. The sulfur content will be increased from 1.14% in 2000 to 1.19% in 2010 and 1.25% in 2015.

At present, catalytic cracking equipment suitable for deep processing of heavy oil among oil refining devices accounts for more and more proportion in China. The catalytic cracking processing capacity accounts for 33.5% of crude oil processing capacity in China, while the processing capacity of catalytic reforming only accounts for 5.66% of crude oil processing capacity. Alkylation accounts for 0.52% of crude oil processing capacity, therefore, raw materials in Chinese gasoline pool include catalytic gasoline (accounting for 73.8%) and naphtha.

Existing low-sulfur high-octane-number gasoline is prepared by mixing FCC gasoline and naphtha refined product according to different proportions.

Existing domestic catalytic gasoline (FCC gasoline) and main refining route of naphtha are respectively as follows:

Selective catalytic gasoline is selectively hydrogenated for removing diolefin. The products are cut in cutting column to obtain light gasoline and heavy gasoline fractions. The light gasoline is etherified by etherification unit (sulfur content of 50-100 ppm), heavy gasoline is desulfurized by selectively hydrogenation apparatus (sulfur content of 10 ppm or so). The refined FCC gasoline blending component is obtained after etherification and hydrodesulfurization products are mixed. The sulfur content of FCC gasoline refined products is generally about 20 ppm after blending.

The main refining route of naphtha is as follows: naphtha is divided into light naphtha and heavy naphtha fractions after cutting pretreatment. Refined light naphtha components can be obtained from light naphtha fraction by isomerization. A part of dry gas, liquefied gas, hydrogen gas and heavy naphtha reformate are generated by sending the heavy naphtha component after cutting pretreatment into the continuous reforming apparatus. Light aromatic components and heavy aromatic components are separated by cutting reformate. Refining heavy naphtha component (1) can be obtained from light aromatic component after benzene extraction for blending with gasoline. Heavy aromatic component and refined heavy naphtha component are obtained by sending the heavy aromatic component into the cutting column again (2). The refined naphtha blending component can be obtained by blending the obtained refined light naphtha fraction component, refined heavy naphtha component (1) and refined heavy naphtha component (2).

Gasoline with low sulfur content can not be easily obtained due to higher sulfur content in light gasoline. The oil product obtained from naphtha can be blended with FCC refined gasoline. However, since catalytic gasoline (i.e. FCC gasoline) accounts for 73.8% in current gasoline pool in China, naphtha only occupies a small portion, 50% of naphtha is used as raw materials for producing ethylene and aromatics, the naphtha for producing high-grade clean vehicle gasoline is prominently insufficient.

The current production method of producing high-grade clean vehicle gasoline (ie, low-sulfur high-octane-number gasoline) by the above technique has the following shortcomings: ① high investment; two selective hydrogenation units in FCC gasoline refining and continuous reforming unit in naphtha refining have higher investment. The device scale is limited by raw materials, and the resources are not rationally utilized, for example, reformate is the main raw material for producing polyester. A large number of reformate is used as high-octane-number gasoline blending component, thereby the scarce polyester raw materials become more deficient. ② High energy consumption: two selective hydrogenation units used in FCC gasoline refining have higher energy consumption rate. Meanwhile, the continuous refining device and cutting column in naphtha refining belong to devices with high energy consumption rate; ③ clean vehicle gasoline with high standards can be produced in whole set and large scale. ④ the clean vehicle gasoline with high standards has lower gasoline quality, and the method only can be used for producing low-grade gasoline products; ⑤ Pollutant emissions are serious.

National V (equivalent to European Union V) standard will be firstly adopted in Beijing in 2012. However, China's crude oil mainly includes catalytic cracking gasoline, while the crude oil has worse and worse quality. Existing technique for producing national V gasoline is characterized by high technical cost, high energy consumption, and incapable continuous mass production. Therefore, the technique of producing high-octane-number low-sulfur gasoline with low investment, low energy consumption and high-grade, consistent with market demand, is urgently demanded for solving problems in the technical field.

INVENTION CONTENTS

One of objects of this invention is to provide a device for the low-cost production of a low-sulphur, high-octane gasoline.

The above object of the invention has been attained through the following technical solution:

A device for the low-cost production of a low-sulphur, high-octane gasoline, characterized in that it comprises an extraction device, a first cutting column, an etherification device, a hydrofinishing desulfurization device, a reforming pretreatment device, a second cutting column, an isomerization device, a reforming device and a stabilizing device; the top of the extraction device is connected with the middle portion of the first cutting column through pipelines; the top of the first cutting column is connected with the etherification device through pipelines; the etherification device is connected with a methanol supplying device; a gasoline product is withdrawn from the etherification device through pipelines; the bottom of the extraction device is connected with the hydrofinishing desulfurization device through pipelines, and the hydrofinishing desulfurization device is connected with the stabilizing device through pipelines; the bottom of the first cutting column is connected with the reforming pretreatment device through pipelines, and the reforming pretreatment device is connected with the middle portion of the second cutting column; the top of the second cutting column is connected with the isomerization device through pipelines, and the isomerization device is connected with the stabilizing device through pipelines; the bottom of the second cutting column is connected with the reforming device through pipelines, the bottom of the reforming device is connected with the stabilizing device through pipelines, and hydrogen containing dry gas and liquefied gas are separately withdrawn from the top of the reforming device; liquefied gas and stable gasoline are separately withdrawn from the stabilizing device, and the obtained stable gasoline is blended with an ethylated gasoline withdrawn from the etherification device, thereby the low-sulphur, high-octane gasoline product is obtained.

The other object of this invention is to provide a method for the low-cost production of a low-sulphur, high-octane gasoline.

The above object of the invention has been attained through the following technical solution:

A method for the low-cost production of a low-sulphur, high-octane gasoline, comprising the following steps:

FCC gasoline enters the extraction device through pipelines for treatment; a raffinate is withdrawn from the top of the extraction device through pipelines, and an extract oil is withdrawn from the bottom of the extraction device through pipelines; the raffinate enters the middle portion of the first cutting column through pipelines; a light raffinate is withdrawn from the top of the first cutting column through pipelines, and a heavy raffinate is withdrawn from the bottom of the first cutting column through pipelines; the light raffinate is connected with the etherification device through pipelines, methanol enters the etherification device through pipelines, and the light raffinate and the methanol are etherified in the etherification device, thereby an etherified gasoline is obtained;

the extract oil enters the hydrofinishing desulfurization device through pipelines for desulfurization, and a hydrogenated oil is withdrawn; the heavy raffinate withdrawn from the bottom of the first cutting device and naphtha enter the reforming pretreatment device through pipelines for reforming pretreatment, and the obtained products enter the second cutting column through pipelines for cutting treatment; a light naphtha is withdrawn from the top of the second cutting column through pipelines, feedstocks for reforming are withdrawn from the bottom of the second cutting column through pipelines; the light naphtha enters the isomerization device through pipelines for isomerization treatment, and an isomerized oil is obtained; the feedstocks for reforming enter the reforming device through pipelines for reforming; hydrogen containing dry gas and liquefied gas are separately withdrawn from the top of the reforming device through pipelines, and a reformate is withdrawn from the bottom of the reforming device through pipelines; after the hydrogenated oil, the isomerized oil and the reformate enter the stabilizing device through pipelines and treated, liquefied gas and stable gasoline are separately withdrawn; the stable gasoline is blended with the etherified gasoline, thereby the low-sulphur, high-octane gasoline is obtained.

A preferred technical solution, characterized in that the distillation range of the fractions withdrawn from the top of the second cutting column is 30-115° C., and the distillation range of the fractions withdrawn from the bottom of the column is 120-195° C.

The invention is further described by drawings and specific embodiments, which is not intended to limit the protection scope of the invention.

BRIEF DESCRIPTION OF DRAWINGS

FIG. 1 is a flow schematic diagram of invention embodiment.

BEST MODE FOR IMPLEMENTING THE INVENTION

Embodiment

FIG. 1 is the flow schematic diagram of the invention embodiment 1. The distillation range is 33.3-198.1° C. The sulfur content is 1500 ppm, nitrogen content is 418ppm, aromatics content is 25% (v), paraffin content is 36.1% (v), olefin content is 38.9%, density at 16° C. is 736.2 kg/m$^3$, octane number is 90, FCC gasoline raw material a with flow rate of 119.048 tons/hour is delivered into extraction column 1 (the same structure as extraction column in Chinese invention patent 200910077505.7, the content of which is herein incorporated by reference in its entirety.). The extraction temperature of extraction column 1 is 130° C., while the extraction pressure is 1.3 MPa (G). The raffinate collected from the top of the extraction column 1 is delivered into the first cutting column 2 at the speed of 77.381 tons/hour (the same structure as the distillation column in the Chinese invention patent 200910077505.7). The temperature at the top of the first cutting column 2 is 96° C., pressure is 0.2 Mpa (G), reflux ratio (to the product) is 2.0 m/m, temperature at the bottom of the column is 186° C., pressure is 0.23 Mpa (G); main properties of light raffinate collected from the top of the first cutting column 2 are as follows: aromatic content is 1% (v), octane number is 85, density is 680 kg/m$^3$, distillation range is 35-105° C., olefin content is 48% (v), sulfur content is 5 ppm, nitrogen content is 2 ppm, light raffinate is delivered into etherification device 3 at the speed of 46.429 tons/hour. Meanwhile, methanol c is also delivered into etherification device at the speed of 4 t/h. Light raffinate is etherified with the methanol. The temperature at the inlet of the etherification device is 55.0° C., pressure is 2.0 MPa (G), and temperature at the outlet is 74.7° C., pressure is 1.8 MPa (G). Main properties of the obtained etherified gasoline are as the follows: aromatic content is 0.8% (v), octane number is 90.5, density is 705 kg/m$^3$, distillation range is 30-125° C., olefin content is 28% (v), chroma is lower than 0.5, the etherified gasoline is obtained by pipeline with the volume of 50.429 tons/ hour. The etherification catalyst used in the etherification device can be conventional etherification catalyst or preferable resin-based catalysts, such as D005 and D005-II-type resin catalyst produced by Dandong Mingzhu Specialty Resin Co., Ltd. and D006 etherification resin catalyst produced by Hebei Kairui Chemical Co. Ltd.

Main properties of extracted oil collected from the bottom of the extraction column 1 are as follows: aromatic content is 69.5% (v), octane number is 99, density is 820 kg/m$^3$, distillation range is 30-201° C., sulfur content is 4226 ppm, the extracted oil is delivered into hydrogenation desulfurization device 4 at the speed of 41.667 tons/hour (extracted oil hydrogenation device in invention patent 200910077505.7) for hydrogenation desulfurization. The temperature at the inlet of hydrogenation desulfurization device 4 is 220° C., the inlet pressure is 3.0 Mpa (G), hydrogen-oil ratio is 300:1 (Nm$^3$/m$^3$), space velocity is 3.0 h$^{-1}$, the hydrotreating catalyst in hydrogenation desulfurization device can be conventional hydrogenation catalyst, the catalyst in the embodiment is hydrogenation catalyst GHT-22 whose physical and chemical properties are shown in Table 1.

TABLE 1

| Indicator Name | Unit | GHT-22 |
|---|---|---|
| Appearance | — | Gray three-leaf type |
| Specification | mm | Φ1.5-2.0 |
| Intensity | N/cm | 180 |
| Bulk density | g/ml | 0.73 |
| Specific surface area | m$^2$/g | 180 |
| Pore volume | ml/g | 0.5-0.6 |
| $WO_3$ | m % | 15 |
| NiO | m % | 1.7 |
| $C_oO$ | m % | 0.15 |
| $Na_2O$ | m % | <0.09 |
| $Fe_2O_3$ | m % | <0.06 |
| $SiO_2$ | m % | <0.60 |
| Carrier | m % | 82.4 |

Main properties of hydrogenated oil obtained after hydrogenation desulfurization are as follows: octane number is 98.5, density is 817 kg/m$^3$, distillation range is 28-200° C., sulfur content is 4 ppm, the hydrogenated oil is collected by pipeline with the output quantity of 41.667 t/h. Main properties of heavy raffinate collected from the bottom of the first cutting column 2 are as follows: aromatic content is 3% (v), density is 746 kg/m$^3$, distillation range is 110-190° C., olefin content is 40% (v), sulfur content is 72 ppm, and nitrogen content is 5 ppm. The heavy raffinate is pretreated in reforming pre-treatment device 5 at the speed of 30.952 tons/hour, while the naphtha b (its main properties: density is 715 kg/m$^3$, distillation range is 30-180° C., sulfur content is 260 ppm, nitrogen content is 1 ppm) is also delivered into the device 5 at the flow rate of 40.477 t/h for pretreatment (desulfurization, denitrification, dechlorination and demetallization), thereby obtaining reforming pretreatment intermediate (main properties: density is 729 kg/m$^3$, distillation range is 30-190° C., sulfur content is less than 1 ppm, nitrogen content is less than 1 ppm, chlorine content is less than 1 ppm, arsenic content is less than 1 ppb, lead content is less than 1 ppb, copper content is less than 1 ppb). The pressure of reforming pretreatment device 5 is 2.5 Mpa (G), temperature is 260° C., hydrogen-oil ratio is 200:1 (Nm$^3$/m$^3$), space velocity is 4.0 h$^{-1}$. The hydrogenation catalyst used in reforming pretreatment device 5 is GHT-22, and its physicochemical properties are shown in Table 1.

The reforming pretreatment intermediate is cut in the second cutting column 6. The temperature at the top of the second cutting column 6 is 101° C., pressure is 0.2 Mpa (G), reflux ratio (to the product) is 1.0 m/m, the temperature at the bottom of the column is 188° C., pressure is 0.23 Mpa (G). Light naphtha fraction is collected from the bottom of the second cutting column 6. The flow rate of the light naphtha fraction is 25 tons/hour. Main properties of light naphtha fraction: octane number is 65, density is 690 kg/m$^3$, distillation range is 30-115° C. The light naphtha fraction is isomerized in isomerization device 7 for obtaining isomerized oil. Main performances of isomerized oil are as follows: Octane number is 81, density is 680 kg/m$^3$, and distillation range is 20-118° C. Operation conditions of the isomerization device are as follows: pressure is 1.0 Mpa (G), temperature is 200° C., hydrogen-oil ratio is 300:1 (Nm$^3$/m$^3$), and space velocity is 1.0 h$^{-1}$. Isomerization catalyst belongs to conventional low temperature noble metal catalyst, such as FI-15 platinum molecular sieve catalyst produced by China Petroleum Fushun Petroleum No. 3 Factory Catalyst Plant.

The reforming raw materials collected from the bottom of the second cutting column 6 are delivered into the reformer 8. Main properties are as follows: the density is 731 kg/m$^3$, the distillation range is 120-195° C., water content is lower than 5 ppm; the pressure of the reformer 8 is 1.0 Mpa (G), temperature is 480° C., hydrogen-oil ratio is 1000:1 (Nm$^3$/m$^3$), space velocity is 2.3 h$^{-1}$. The catalyst used in the reformer 8 is the half-regeneration reforming catalyst Pt-Re/$Al_2O_3$ (CB-7) which can be purchased from the market.

The reformate is collected from the bottom of the reformer 8 with the output quantity of 41 t/h, and the main properties are as follows: aromatic content is 51%, octane number is 98, density is 758 kg/m$^3$, distillation range is 20-200° C., benzene content is 0.5% (v). Hydrogen f containing dry gas (output quantity: 2.2 tons/hour) and liquefied gas g (output quantity: 3.229 t/h) are collected from the top of the reformer 8; the hydrogenated oil obtained from hydrogenation desulfurization device, isomerized oil obtained from the isomerization device and reformate obtained from the reformer are treated in the stabilizing device 9. The stable gasoline and liquefied gas d are collected. The temperature at the top of the stabilizing column in the stabilizing device 9 is 70° C., pressure is 1.5Mpa (G), reflux ratio (to the product) is 0.2 m/m, the temperature at the bottom of the column is 200° C., pressure is 1.54 Mpa (G). The output quantity of stable gasoline is 104.762 t/h, and its main properties are as follows: aromatic content is 46% (v), octane number is 94.3, density is 759 kg/m$^3$, distillation range is 31-196° C., sulfur content is 2 ppm, benzene content is 0.3% (v); the output quantity of the liquefied gas d is 2.905 tons/hour. The stable gasoline is blended with etherified gasoline to obtain the final product of low-sulfur high-octane-number gasoline.

Main properties of low sulfur high-octane gasoline are as follows: aromatic content is 31.5% (v), octane number is 93.1, density is 741 kg/m$^3$, distillation range is 30-194° C., olefin content is 9.3% (v), the sulfur content is 3 ppm, and benzene content is 0.2% (v).

Extraction column, cutting column and hydrogenation desulfurization device in the invention are respectively extraction column, distillation column and extracted oil hydrogenation device disclosed in Chinese invention patent of 'device of preparing high-quality gasoline by hydrogenation after component refining hydrocarbon reorganization and method thereof' with patent number 200910077505.7.

The reformer used in the invention is disclosed by the following patent: A naphtha productive aromatic hydrocarbon reformer, Publication No.: CN201241102; A productive aromatic hydrocarbon reformer with benzene separation, Publication No.: CN201665667; A productive aromatic hydrocarbon reformer of evaporation dehydration unit with side line output, Publication No.: CN201459048; A naphtha reformer of producing raffinate, benzene and mixed aromatic hydrocarbon, publication number: CN201459036; A naphtha reformer of producing raffinate and mixed aromatic hydrocarbon, Publication No.: CN201459035; A reformer of productive aromatic hydrocarbon, Publication No. : CN201459034; A reformer of evaporation dehydration unit with side line output and benzene separation, Publication No.: CN201722339; A reformer of productive aromatic hydrocarbon with benzene separation and kerosene production, publication No.: CN201517089; A reformer of producing mixed aromatic hydrocarbon and kerosene reformer, Publication No.: CN201459050; A reformer of producing productive aromatic hydrocarbon and kerosene, Publication No.: CN201512504; A reformer of producing benzene, mixed aromatic hydrocarbon and kerosene, Publication No.: CN201459049; An improved naphtha productive aromatic hydrocarbon reformer, Publication No.: CN201459047; A naphtha productive aromatic hydrocarbon reforming system with side line cutting column, Publication No.: CN201459046; A reforming system of productive aromatic hydrocarbon, Publication No.: CN201459045; A naphtha productive aromatic hydrocarbon reforming system with solvent recovery system, Publication No.: CN201459044; A naphtha reforming system, Publication No.: CN201665668; A productive aromatic hydrocarbon reforming system with side line cutting system and recovery system, Publication No.: CN201459043; A reforming system of naphtha productive aromatic hydrocarbon, publication No.: CN201459042; A reforming system of naphtha productive high-octane-number gasoline and productive aromatic hydrocarbon, Publication No.: CN201459041; A reforming system with evaporative dewatering system, Publication No.: CN201459038; A reforming system, Publication No.: CN201459040; A reforming system with evaporative dewatering system, Publication No.: CN201459039; A productive high-octane-number gasoline reforming system of producing kerosene, Publication No.: CN201459037; A reforming system of productive high-octane-number gasoline, Publication No.: CN201459053; A reforming system of kerosene, Publication No.: CN201665669; A productive high-octane-number gasoline reforming system with evaporative dewatering system, Publication No.: CN201459052; A productive high-octane-number gasoline reforming system with evaporative dewatering system, Publication No.: CN201459051. The contents of all the above mentioned patents and patent application publications are herein incorporated by reference in their entirety.

Stabilizing device in the invention is a conventional apparatus, which is composed of a column, an air cooler, a water cooler, a reflux tank, a reflux pump, a column bottom pump, etc.

The reforming pre-treatment device, etherification device and isomerization device in the invention belong to commonly used devices in the technical field.

The measurement method used in the invention is as follows:

1. Distillation range: GB/T6536-1997 petroleum product distillation measurement method;

2. Sulfur content: Total sulfur content measurement method of SH/T0689-2000 light hydrocarbon, engine fuel and other oil products (UV fluorescence method);

3. Olefin content: GB/T11132-2002 hydrocarbon measurement method of liquid petroleum product (fluorescent indicator adsorption method);

4. Aromatic content: GB/T11132-2002 hydrocarbon measurement method of liquid petroleum products (fluorescent indicator adsorption method);

5. Octane number: GB/T5487 gasoline octane number measurement method (research method);

6. Density: GB/T1884-2000 crude oil and liquid petroleum product density laboratory measurement method (density meter method);

7. Nitrogen content: SH/T0704-2001 measurement method of nitrogen content in petroleum and petroleum products (chemiluminescence method);

8. Paraffin content: SH/T0714-2002 monomer hydrocarbon composition measurement method in naphtha (capillary gas chromatography method);

9. Benzene content: SH/T 0713-2002 benzene and toluene content measurement method in motor gasoline and aviation gasoline (gas chromatography method);

10. Water content: GB/T11133-2004 measurement method of water content in liquid petroleum product—(Karl Fischer method);

INDUSTRIAL APPLICABILITY

Sulfur in raw material FCC gasoline is enriched in extracted oil by introducing extractor in the invention (System of preparing high quality gasoline by hydrogenation after component refining hydrocarbon reorganization, Application No. 200910077505.7), thereby reducing the scale of hydrogenation desulfurization device, and lowering the equipment investment and hydrogenation scale. The scale of reformer is increased by handling heavy raffinate obtained from the bottom of the first cutting column in the reforming pretreatment device. The precursor which can generate benzene in the reforming process is delivered into isomerization device to generate isomerized oil, thereby reducing the formation of benzene, and the distillation range meets the gasoline standards. Benzene extractor and corresponding fractionation device are saved, thereby greatly lowering investment and energy consumption, and increasing the gasoline yield. The investment of reformer is reduced, while the liquid yield is increased by introducing the reformer. Meanwhile, the stabilizing devices (systems) respectively connected with the hydrogenation desulfurization device, isomerization device and reformer are combined into one stabilizing device, thereby reducing the quantity of stabilizing device and saving investment as well as energy consumption. The sulfur content in all gasoline products is lowered to 10 ppm by selecting the device and method. Meanwhile, the octane number is improved, the olefin content is lowered, which are in accordance with the Euro V standard. The device and method have obvious advantages in investment, hydrogenation scale, product cleanliness, quality, etc.

The invention claimed is:

1. A method for the low-cost production of a low-sulphur, high-octane gasoline, the method comprising the following steps:

FCC gasoline enters an extraction device through pipelines for treatment; a raffinate is withdrawn from the top of the extraction device through pipelines, and an extract oil is withdrawn from the bottom of the extraction device through pipelines; the raffinate enters a middle portion of a first cutting column through pipelines; a light raffinate is withdrawn from the top of the first cutting column through pipelines, and a heavy raffinate is withdrawn from the bottom of the first cutting column through pipelines; the light raffinate is fed into an etherification device through pipelines, methanol enters the etherification device through pipelines, and the light raffinate and the methanol are etherified in the etherification device, thereby an etherified gasoline is obtained;

the extract oil enters a hydrofinishing desulfurization device through pipelines for desulfurization, and a hydrogenated oil is withdrawn from the hydrofinishing desulfurization device; the heavy raffinate withdrawn from the bottom of the first cutting device and naphtha enter a reforming pretreatment device through pipelines for reforming pretreatment, and obtained products from the reforming pretreatment device enter a second cutting column through pipelines for cutting treatment; a light naphtha is withdrawn from the top of the second cutting column through pipelines, feedstocks for reforming are withdrawn from the bottom of the second cutting column through pipelines; the light naphtha enters an isomerization device through pipelines for isomerization treatment, and an isomerized oil is withdrawn from the isomerization device; the feedstocks for reforming enter a reforming device through pipelines for reforming; hydrogen containing dry gas and liquefied gas are separately withdrawn from the top of the reforming device through pipelines, and a reformate is withdrawn from the bottom of the reforming device through pipelines; after the hydrogenated oil, the isomerized oil and the reformate enter a stabilizing device through pipelines and treated, liquefied gas and stable gasoline are separately withdrawn from the stabilizing device; the stable gasoline is blended with the etherified gasoline, thereby the low-sulphur, high-octane gasoline is obtained.

2. The method for the low-cost production of a low-sulphur, high-octane gasoline according to claim 1, wherein the distillation range of the fractions withdrawn from the top of the second cutting column is 30-115° C., and the distillation range of the fractions withdrawn from the bottom of the second cutting column is 120-195° C.

3. The method for the low-cost production of a low-sulphur, high-octane gasoline according to claim 1, wherein the FCC gasoline has a distillation range of 33.3-198.1° C.

4. The method for the low-cost production of a low-sulphur, high-octane gasoline according to claim 1, wherein the heavy raffinate and the naphtha entering the reforming pretreatment device has a distillation range of 110-190° C. and 30-180° C., respectively.

* * * * *